United States Patent [19]

Wagner

[11] Patent Number: 5,056,347

[45] Date of Patent: Oct. 15, 1991

[54] HAND-HELD BENDING TOOL FOR CONDUITS AND RODS

[75] Inventor: Rudolf Wagner, Stuttgart, Fed. Rep. of Germany

[73] Assignee: REMS-Werk Christian Föhl und Söhn GmbH & Co., Waiblingen, Fed. Rep. of Germany

[21] Appl. No.: 475,141

[22] Filed: Feb. 2, 1990

[30] Foreign Application Priority Data

Feb. 2, 1989 [DE] Fed. Rep. of Germany ..... 3903041

[51] Int. Cl.[5] ..... B21D 7/04

[52] U.S. Cl. ..... 72/149; 72/157; 72/449

[58] Field of Search ..... 72/149, 157, 159, 217, 72/218, 387, 458, 459, 154, 155, 449

[56] References Cited

U.S. PATENT DOCUMENTS

| | | | |
|---|---|---|---|
| 1,795,188 | 3/1931 | Wagenbach | 72/157 |
| 1,849,181 | 3/1932 | Francis | 72/159 |
| 3,236,082 | 2/1966 | Beck et al. | 72/149 |
| 3,417,590 | 12/1968 | Ensley | 72/159 |
| 3,433,042 | 3/1969 | Crihfield et al. | 72/217 |
| 3,949,584 | 4/1976 | Pearson et al. | 72/149 |
| 4,546,632 | 10/1985 | Van Den Kieboom | 72/159 |
| 4,981,030 | 1/1991 | Capparusso et al. | 72/149 |
| 4,986,104 | 1/1991 | Capporusso et al. | 72/149 |

FOREIGN PATENT DOCUMENTS

| | | | |
|---|---|---|---|
| 0100828 | 8/1980 | Japan | 72/157 |

*Primary Examiner*—David Jones

*Attorney, Agent, or Firm*—Robert W. Becker & Associates

[57] ABSTRACT

A hand-held bending tool for conduits, tubes, rods, and the like is provided. The bending tool includes a bending matrix and a sliding shoe that during a bending process are movable relative to one another and each have a groove-like recess in which the tube that is to be bent is disposed. The recess of the bending matrix extends in a curved manner in conformity with the tube bending radius that is to be produced. The tool includes at least one support for the tube. The tube is embodied as an electric tool having a motor that rotatably drives the bending matrix via a reduction gear arrangement, with the flux of force during a bending process being self-contained.

26 Claims, 3 Drawing Sheets

HAND-HELD BENDING TOOL FOR CONDUITS AND RODS

BACKGROUND OF THE INVENTION

The invention relates to a hand-held bending tool for conduits, tubes, rods, and the like, including a bending matrix and a sliding shoe that during the bending process are movable relative to one another and each have groove-like recess means in which the tube that is to be bent is disposed, with the recess means of the bending matrix extending in a curved manner in conformity with the tube bending radium that is to be produced, and including at least one support for the tube.

Such hand-held bending tools serve for the bending of tubes, especially in the plumbing or sanitation field. With the known hand-held bending tool of the aforementioned type, the sliding shoe is pivotably mounted on a lever that is in turn pivotably mounted on a lever that is provided with the bending matrix. The support for the tube is secured to this lever that is provided with the bending matrix. To bend the tube, the lever with the sliding shoe is pivoted relative to the lever with the bending matrix, as a result of which the tube that is supported on the support is bent about the bending matrix. If the tubes are made of hard material, considerable bending forces have to be exerted. For this reason, the levers are relatively long in order to provide enough leverage to be able to apply adequate bending forces. Despite these long levers, it is still necessary to exert considerable force in order to bend the tube to the desired extent. Where the workpieces that are to be bent are made of hard material, or have large diameters, the bending forces that are required are so high that the hand-held bending tool must be clamped, for example in a vice, in order to be able to absorb the reaction forces or torque. Furthermore, due to the long levers this hand-held bending tool is bulky and cumbersome.

Bending machines are also known that, however, due to their great weight can no longer be carried by hand, but rather must be embodied as a stationary device. For this reason, it is impossible or at least difficult to use this known machine for bending tubes on location.

It is an object of the present invention to embody a hand-held bending tool of the aforementioned general type in such a way that it is compact and manageable, and that does not require the user to exert any great forces for the bending process.

SUMMARY OF THE INVENTION

The bending tool of the present invention is characterized primarily in that it is embodied as an electrical tool having a motor that rotatably drives the bending matrix via a reduction gear arrangement, with the flux of force during the bending process being self-contained.

The inventive hand-held bending tool is embodied as an electrical tool that has only small dimensions, is lightweight, and can therefore also be comfortably handled by the user. The inventive hand-held bending tool can therefore be taken along at any time by the workmen to the construction site, and can be used on location. During the bending process, the bending matrix is driven by a motor, so that the user himself does not have to exert any force for the bending process. As a result, the user can effortlessly carry out a number of bending processes. With the electric tool, it is in particular possible to bend hard workpieces, whereby the user himself does not have to exert any force for the bending. Since the flux of force during the bending process is self-contained, the user does not even have to support the inventive electric tool relative to reaction forces or torque. As a matter of fact, the user can even place the electric tool on a surface during the bending process without having to fear that the electric tool will execute uncontrolled movements. The inventive electric tool is thus characterized by a compact construction, a low weight, and an extremely easy handling.

Further features of the invention can be derived from the further claims, the specification, and the drawings.

BRIEF DESCRIPTION OF THE DRAWINGS

The invention will be described in detail with the aid of one exemplary embodiment illustrated in the drawings, which show.

DESCRIPTION OF PREFERRED EMBODIMENTS

Figure 1:
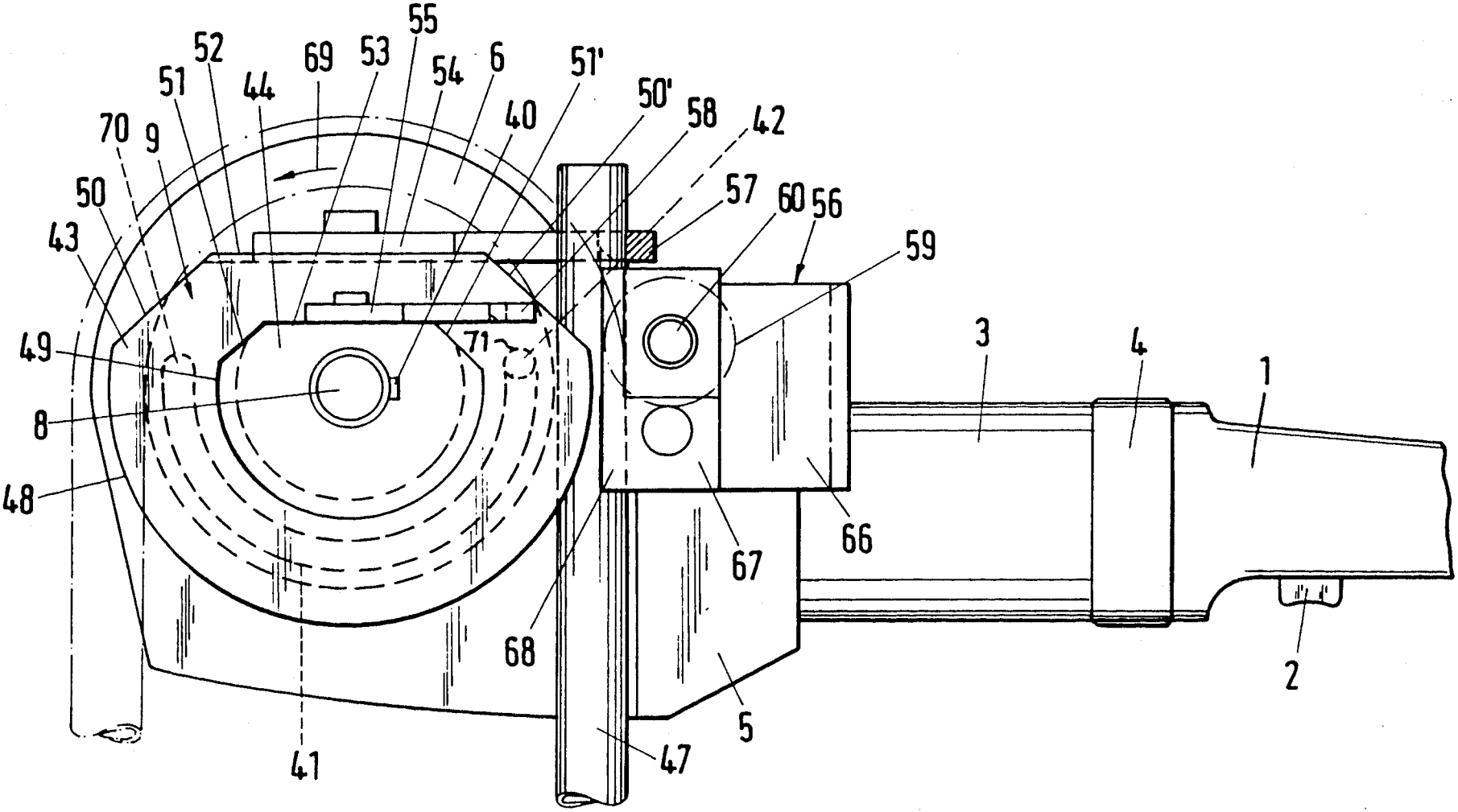
FIG. 1 a plan view of one inventive hand-held bending tool that is embodied as an electrical tool, FIG. 2 an enlarged and partially cross-sectioned view of a bending matrix as well as a shoe of the inventive hand-held bending tool during the bending process, FIG. 3 a cross-sectional view of a portion of the gear mechanism between a drive motor and a drive element for the bending matrix of the inventive hand-held bending tool.

Tho hand-held bending tool is embodied as an electrical tool with which conduits, tubing, rods, and the like can be bent. The hand-held bending tool is especially advantageous in the plumbing and sanitation field. Due to its lightweight construction of only approximately 4 to 6 kg, the bending tool can be easily used, for example, at a construction site, so that the workpieces can be bent to the desired extent right on location.

The hand-held bending tool has an elongated handle 1, from the free (non-illustrated) end face of which extends a power supply line. The handle 1 is provided on its underside with an on-off switch 2 via which an electric motor that is accommodated in a housing 3 can be operated. The handle 1 is preferably screwed onto the motor housing 3, so that the electric motor is easily accessible for repair purposes. In order to be able to alter the direction of rotation of the electric motor, a selector or reversing switch 4 in the form of a ring is disposed at that end of the motor housing 3 that faces the handle 1. At that end remote from the handle 1, an intermediate housing 5, in which is accommodated a reduction gear mechanism, is attached, preferably detachably, to the housing 3. An annular housing 6 is connected, preferably detachably, to the intermediate housing 5; the housing 6 is provided with a driven receiving ring 7 (FIG. 3) in which can be placed a drive element 8 for a bending matrix 9.

Figure 3:
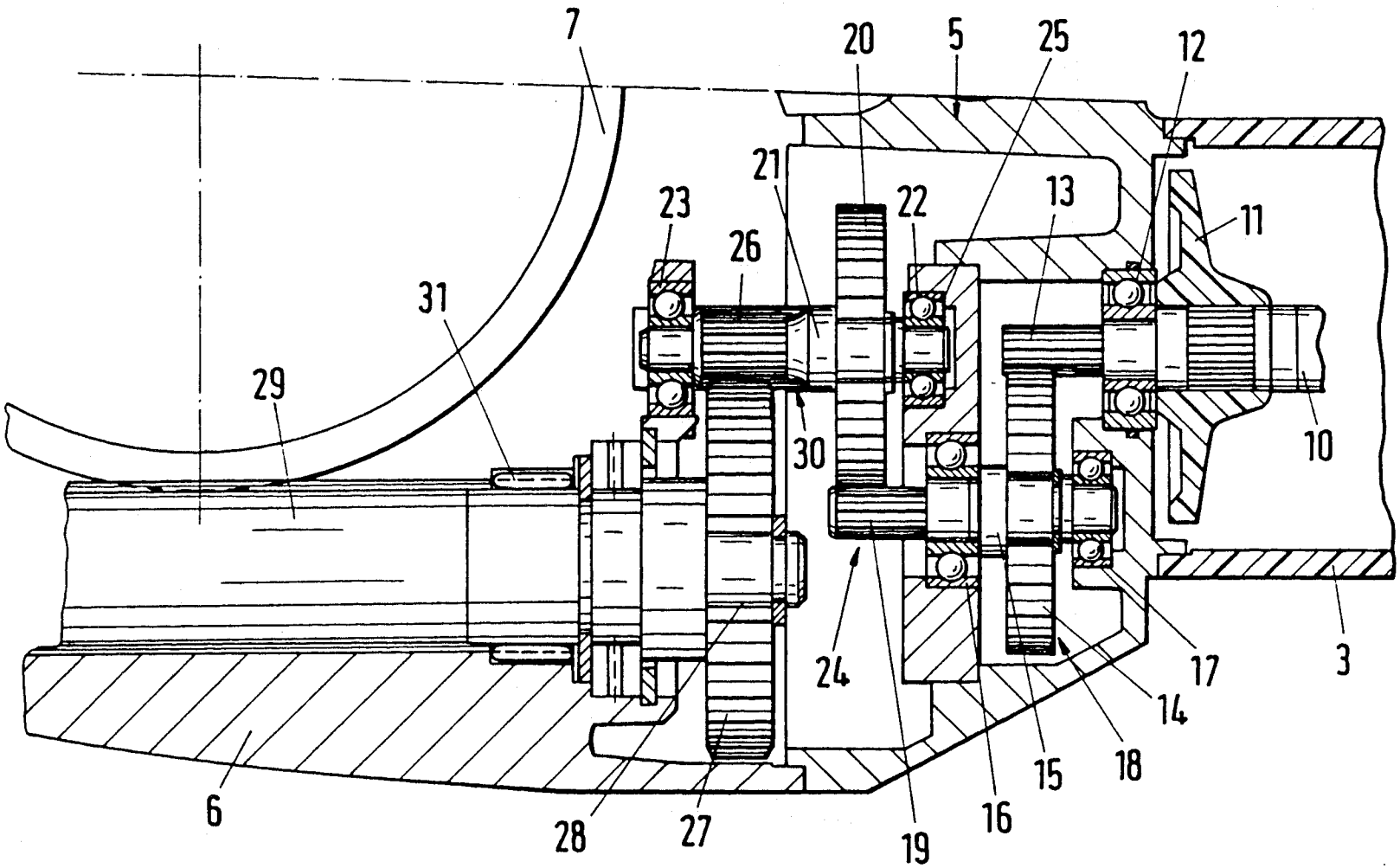

The handle casing and the motor housing 3 are expediently made of an electrically insulating plastic. As shown in FIG. 3, the electric motor that is accommodated in the housing 3 has a drive shaft 10 that within the motor housing 3 carries a fan wheel 11, which is preferably made of plastic. The drive shaft 10 is rotatably mounted within the intermediate housing 5 via a roller bearing 12, preferably a ball bearing. The free end of the drive shaft 10 is embodied as a pinion 13 that meshes with a gear wheel 14 on an intermediate shaft 15. This shaft is rotatably supported within the intermediate housing 5 in two roller bearings 16 and 17, preferably ball bearings, that are disposed on both sides of the gear wheel. The pinion 13 and the gear wheel 14 form a first gear stage 18.

The one end of the intermediate shaft 15 is embodied as a pinion 19 that meshes with a gear wheel 20 on a further intermediate shaft 21. The intermediate shaft 21 is disposed parallel to the intermediate shaft 15 and is also rotatably mounted in two roller bearings 22 and 23, which again are preferably ball bearings. The roller bearing 22 is accommodated within the intermediate housing 5, and the roller bearing 23 is accommodated in the housing 6. The pinion 19 and the gear wheel 20 form a second gear stage 24. The intermediate shaft 21 is aligned with the drive shaft 10. The roller bearings 16 and 22 are accommodated in a common bearing member 25 that is preferably removably disposed in the intermediate housing 5.

In the region between the two roller bearings 22, 23, the intermediate shaft 21, in addition to the gear wheel 20, is also provided with a pinion portion 26 via which the intermediate shaft 21 meshes with a gear wheel 27 on an extension 28 of a worm gear 29. The pinion portion 26 and the gear wheel 27 form a third gear stage 30 that is accommodated in the annular housing 6.

The worm gear 29 is rotatably mounted in the annular housing 6 via roller bearings 31. In FIG. 3, only one of the roller bearings 31 is shown. The worm gear 29 is in engagement with the receiving ring 7, which is embodied as a worm gear and is rotatably mounted in the housing 6.

The drive shaft 10 is drivingly connected in the manner described with the worm gear 29 via a multi-stage gear arrangement, in the illustrated embodiment via a three-stage gear arrangement 18, 24, 30. This results in a high reduction ratio while maintaining a compact construction, with the worm gear arrangement 29, 7 contributing to the compact construction of the hand-held bending tool in a particularly advantageous manner.

Figure 2:
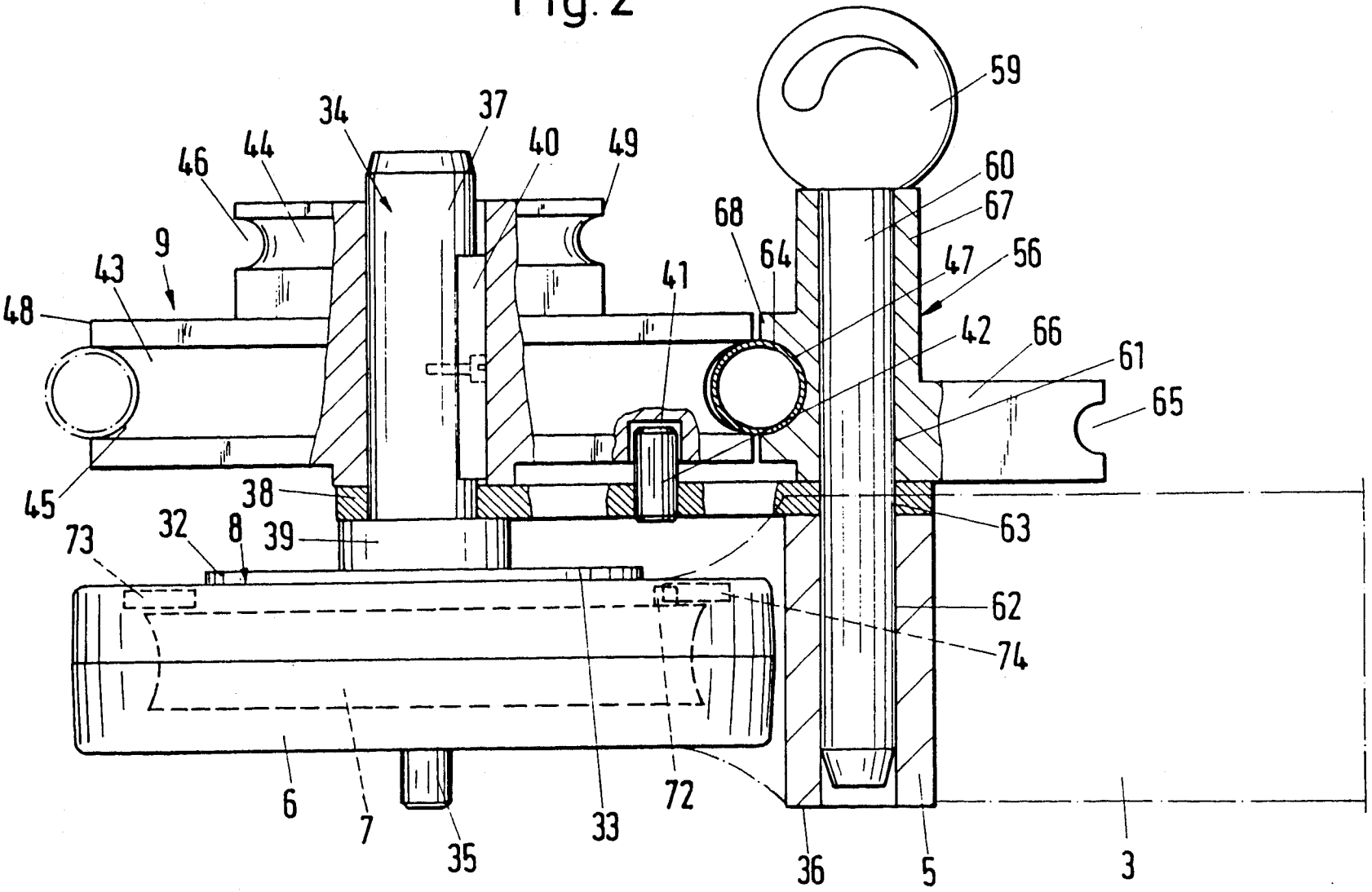

The receiving ring 7, which is axially secured in the annular housing 6, is provided with a receiving opening for the drive element 8. The receiving ring 7 is provided with a (non-illustrated) driving means that is preferably embodied as a catching element and that meshes with a corresponding catching recess of the drive element 8. The drive element 8 has a cylindrical (non-illustrated) ring, the outer surface of which rests against the opening wall of the receiving ring 7. The ring is connected to the catching recess in which the driving means of the receiving ring 7 engages. Connected to the ring is a radially outwardly directed flange 32 (FIG. 2) via which the drive element 8 rests against one end face of the receiving ring 7. The flange 32 forms the outer rim of a head 33 that closes off the ring of the drive element 8 on one side. A shaft 34, which is fixedly connected with the drive element 8, extends through the head; in FIG. 2, the upper portion of the shaft is thicker than the lower portion. The thinner portion 35 of the shaft 34 extends slightly beyond the housing 6 (FIG. 2). The end face of the shaft portion 35 is preferably disposed in a common plane with the corresponding outer wall 36 of the intermediate housing 5. Consequently, during a bending process the hand-held bending tool can be placed upon a flat surface in the position illustrated in FIG. 2.

Rotatably seated on the thicker shaft portion 37 is a guide piece 38 that in the installed state rests on a widened portion 39 of the shaft 34. In the region above the guide piece 38, the thicker shaft portion 37 is provided with a key 40 to torque-drive the bending matrix 9. The key 40 is preferably removably provided on the shaft portion 37 so that it can be easily replaced if necessary. In the installed state, the bending matrix 9 rests upon the guide piece 38.

The underside of the bending matrix 9 is provided with a recess 41 that extends over more than 180°; a stop means 42 extends into the recess. The stop means is provided in the guide piece 38 and is preferably formed by a pin that projects with play into the recess 41 of the bending matrix 9 (FIG. 2). The bending matrix 9 has two bending segments 43 and 44 that each have a configuration in the shape of part of a circle; these bending segments have different bending radii, with the bending segment 43 having a larger diameter than does the bending segment 44. The periphery of each of the bending segments 43, 44 is provided with a recess 45, 46 that has an approximately semicircular cross-sectional configuration that is curved in conformity with the bending radius of the tube 47 that is to be produced; during the bending process, these recesses serve for accommodating the tube 47 that is to be bent. The two recesses 45 and 46 have different cross-sectional diameters, and are therefore provided for accommodating tubes of different thicknesses. The recesses 45 and 46 extend over an angular range of somewhat more than 180°. The ends of the outer surfaces 48 and 49 that are provided with the recesses 45 and 46 merge into converging, outer surfaces 50, 50' and 51, 51' of the bending segments 43 and 44. In the illustrated embodiment, the planar outer surfaces 50, 50' and 51, 51' preferably extend parallel to one another and are interconnected by planar outer surfaces 52 and 53. These outer surfaces serve as abutment surfaces for a respective support 54 and 55 that is preferably removably secured to a respective bending segment 43 and 44 and has a plate-shaped configuration. The parallel supports 54 and 55 serve during the bending process to support the tube 47 that is to be bent. Those ends 57 and 58 of the two supports 54 and 55 that face a sliding shoe 56 have a hook-like configuration. In the manner illustrated in FIG. 1, the tube 47 that is to be bent is placed in the hook opening of the respective support 54 or 55. The hook opening is advantageously rounded off in such a way that the surface of the tube 47 rests against the wall of the hook opening.

The sliding shoe 56 is detachably secured to the hand-held bending tool. Provided for this purpose, as shown in FIG. 2, is an insertion spindle 60 that is provided with handgrip means 59 and is inserted into an insertion opening 62 of the intermediate housing 5 via an opening 61 that extends through the sliding shoe 56. The guide piece 38, near its free end, is similarly provided with an opening 63 through which the insertion spindle 60 extends. As can be seen from FIG. 2, the openings 61 and 63, as well as the insertion opening 62, having the same diameter, which corresponds to the diameter of the insertion spindle 60. Thus, via the insertion spindle 60, the guide piece 38, which is rotatably seated upon the shaft 34, is secured against rotation. The sliding shoe 56 rests upon the guide piece 38, which in turn rests upon the intermediate housing 5. In this way, the openings 61 to 63 form a continuous insertion opening into which the entire length of the insertion spindle 60 extends. Since the openings 61 to 63 have the same diameter as does the insertion spindle 60, the sliding shoe 56 does not execute any uncontrolled movements during the bending process.

When viewed in plan (FIG. 1), the sliding shoe 56 has an essentially square contour. The sliding shoe, as can be seen in FIG. 2, has two recesses 64 and 65 that are disposed at different levels and have an at least nearly semicircular cross-sectional configuration; these recesses have different cross-sectional diameters and serve during the bending process to receive the respective tube 47 that is to be bent. The cross-sectional diameters of the recesses 64 and 45 of the sliding shoe 56 and the bending matrix 9 correspond to one another; similarly, the recesses 46 and 65 have the same cross-sectional diameter. In the position illustrated in FIG. 2, the portion 66 of the sliding shoe 56 that is provided with the recess 65 rests upon the guide piece 38. As a result, in the starting position of the bending matrix 9 illustrated in FIGS. 1 and 2, the recess 64 is disposed across from the recess 45 of the bending matrix. After the insertion spindle 60 has been withdrawn, the sliding shoe 56 can be turned by 180°, so that a projection 67 of the sliding shoe that extends in the axial direction of the opening 61 rests upon the guide piece 38. In this situation, the recess 65 is disposed across from the recess 46 of the bending matrix 9. The portion 66 that contains the recess 65 extends transverse to the longitudinal axis of the opening 61 and is of such a length that it is slightly spaced from the bending segment 44. The portion 68 of the sliding shoe 56 that is provided with the recess 64, and that similarly extends transverse to the longitudinal axis of the opening 61, is considerably shorter than the portion 66. As can be seen from FIG. 2, this portion 68 is spaced only slightly across from the bending segment 43 of the bending matrix 9. The recesses 64 and 65 extend over the entire length of the two portions 68 and 66 and in each case extend linearly.

The recesses 64 and 65 of the sliding shoe 56 and the hook-like ends 57 and 58 of the supports 54 and 55 of the bending matrix 9, are embodied in such a way that in the starting position of the bending matrix 9 (FIG. 1), the base of the respective recess 64 or 65 of the sliding shoe 56 is aligned with the base of the hook opening of the hook-like end 57 or 58 of the support 54 or 55.

In FIGS. 1 and 2 the sliding shoe 56 is disposed in such a way that its recess 64 is disposed across from the recess 45 of the bending matrix 9. In the starting position of the bending matrix, the support 54 that is associated with the recess 45 extends at right angles to the axis of the tube 47 that is to be bent. The starting position of the bending matrix 9 is determined by the stop means 42, which rests against one end of the partial circle recess 41 in the bending matrix 9 (FIG. 1). In this starting position, the as of yet nondeformed tube 47 can be easily inserted between the bending matrix 9 and the sliding shoe 56 until it reaches the hook-like opening of the support 54. The selector 4 is set in such a way that when the electric motor is turned on, the bending matrix 9 rotates about its axis in the direction of the arrow 69. Since the support 54 is fixedly connected with the bending matrix, it is carried along in the same direction. Since the hook-like end 57 extends about that side of the tube 47 that faces away from the axis of rotation of the bending matrix, the tube 47 is carried along in a rotational manner upon rotation of the bending matrix 9. In so doing, an optimum reduction of the speed of the drive shaft 10 is achieved via the multi-stage reduction gear mechanism described in conjunction with FIG. 3. When the bending matrix 9 is rotated, the tube 47, which rests against the sliding shoe 56 is pulled along. The tube 47 is bent in conformity with the rotational angle of the bending matrix 9. For example, FIG. 1 illustrates in dot-dash lines a tube 47 that has been bent by 180°. At the end of the rotational movement, the end 70 of the recess 41 comes to rest against the stop means 42. This terminates the rotational movement of the bending matrix 9. To prevent the motor from overloading, a (non-illustrated) torque overload or slipping clutch then becomes operative. When the switch 2 is released, the electric motor is turned off.

In order to be able to remove the tube 47, it is merely necessary to withdraw the insertion spindle 60, which is disposed parallel to the axis of rotation of the bending matrix, via the handgrip means 59. The sliding shoe 56 can then be removed at right angles from the tube 47, i.e. from the bending matrix 9, so that the bent tube 47 can be effortlessly removed. In order to return the bending matrix 9 into the starting position of FIG. 1 for a new bending process, the selector 4 is merely actuated, so that the electric motor now runs in the opposite direction when it is turned on and turns the bending matrix 9 back into the starting position counter to the direction of rotation 69. This starting position is achieved when the end 71 of the recess 41 of the bending matrix 9 butts against the stop means 42. To prevent the motor from overloading, in this case also the (non-illustrated) torque overload becomes operative in the event that the motor continues to run in the abutment position.

If a tube having a smaller diameter is to be bent in the manner described, the projection 67 of the sliding shoe 56 is placed upon the guide piece 38, and subsequently the sliding shoe is secured to the intermediate housing 5 via the insertion spindle 60 in the manner described. In this case, the portion 66 having the smaller recess 65 is then opposite the recess 46 of the bending segment 44 of the bending matrix 9. The tube that is to be bent is then again placed in the manner described between the bending segment 44 and the sliding shoe 56, as a result of which the tube is disposed in the two recesses 46 and 65. The tube is again inserted to such an extent that it extends through the hook opening of the support 55. After the electric motor has been turned on, the bending matrix 9 is rotated in the direction of rotation 69, as a consequence of which the tube is bent in the manner described.

The hand-held bending tool is embodied as a compact electric tool that is easy to operate, and with which in a very simple manner tubes having very different diameters can be bent. Depending upon the diameter of the tube, different bending matrixes and sliding shoes can be very easily installed on the hand-held bending tool. The bending matrix 9 can be very easily exchanged, since it merely has to be placed upon the shaft 34. In the illustrated embodiment, the bending matrix 9 has two bending segments 43, 44 for tubes 47 having different diameters. It is also readily possible to provide the bending matrix 9 either with only a single bending segment, or with more than two bending segments. The sliding shoe 56 is then correspondingly provided with only a single recess or with more than two recesses. An entire set of bending matrixes and sliding shoes can be made available to the workman, so that he can bend the tubes that he has before him. The hand-held bending tool can easily be held by hand during the bending process and need not be clamped into a vice or the like. The hand-held bending tool has a closed flux of force, so that the operator does not himself have to absorb any reaction forces or torque. This also makes it possible to place the hand-held bending tool, for example on a surface, during the bending process and to turn it on. The bending process then takes place entirely automatically. No torque occurs during the bending process, so that the hand-held bending tool does not have to be supported relative to such torque.

In the described and illustrated embodiment, the drive element 8, which is provided with the shaft 34, is placed in the driven member 7. An embodiment is also conceivable where the driven member 7, which is embodied as a worm gear, is integrally embodied with the shaft 34 upon which the bending matrix 9 can be disposed. Pursuant to a further embodiment, the bending matrix 9 could also be integrally embodied with the drive element 8.

In order to be able to easily remove the sliding shoe 56 after the bending process, the insertion spindle 60 is withdrawn in the manner described, so that the sliding shoe 56 can be pulled away transversely from the bending matrix 9. Instead of the insertion spindle 60, the sliding shoe 56 could also be disposed in such a way that it is pivotable about an axis that is disposed parallel to the axis of rotation of the bending matrix 9. In such a case, the pivot axis is disposed near one end of the recess 64 or 65. After termination of the bending process, the sliding shoe 56 can then be pivoted away about this axis, so that the bend tube 47 can be removed from the bending matrix 9. The pivot axis for the sliding shoe 56 can also be disposed transverse, especially perpendicular, to the axis of rotation of the bending matrix 9.

Instead of the insertion spindle 60, an embodiment is also conceivable where the spindle is fixedly connected with the housing 3, 5. In this case, the sliding shoe 56 and the bending matrix 9 are disposed on this fixed spindle and on the shaft 34. After the bending process, the bending matrix 9, the sliding shoe 56, and the tube 47, which is disposed therebetween and is now resiliently bent, are then withdrawn together from the shaft 34 and the fixed spindle. In this case, it is also possible for the spindle to be fixed or integral with the sliding shoe 56, so that the sliding shoe along with the spindle can be disposed in an appropriate receiving opening of the housing 3, 5.

The guiding piece 38 absorbs the bending moments that occur during the bending process in the region between the insertion spindle 60 and the axis of rotation of the bending matrix 9, so that the connection location between the annular housing 6 and the intermediate housing 5 does not have to absorb any bending moments.

The shaft 34, at least in the thicker shaft portion 37, can have an angular cross-sectional configuration, so that the bending matrix 9 can be fixedly connected with the shaft 34 without having to use the key 40.

In order to limit the rotational path of the bending matrix 9, it is also possible to provide a stop means 72 on the worm gear 7 within the housing portion 6, with two counter abutments 73 and 74 being secured within the housing 6 against which the stop means 72 respectively comes into engagement (dashed lines in FIG. 2).

I claim:

1. In a hand-held bending tool for conduits, tubes, and rods, including a bending matrix and a sliding shoe that during a bending process are movable relative to one another and each have a groove-like recess means in which said tube that is to be bent is disposed, with said recess means of said bending matrix extending in a curved manner in conformity with the tube bending radius that is to be produced, and including at least one support for said tube, the improvement wherein:

said bending tool is embodied as an electrically powered tool having an electric motor with a drive shaft that rotatably drives said bending matrix via a reduction gear arrangement having an at least two stage reduction mechanism, with the force caused by said tool during a bending process being self-contained in such a way that said force during said bending process is absorbed by said hand-held bending tool without requiring a reaction force by the operator.

2. A hand-held bending tool according to claim 1, wherein said drive shaft is operatively connected to a driven member of said reduction gear arrangement via a four-stage reduction gear mechanism.

3. A hand-held bending tool according to claim 2, in which said driven member is a worm gear.

4. A hand-held bending tool according to claim 2, in which said driven member is embodied as a receiving ring for a drive element of said bending matrix.

5. A hand-held bending tool according to claim 4, in which said drive element has a shaft on which said bending matrix is disposable.

6. A hand-held bending tool according to claim 2, in which said drive element is detachably connected to said driven member.

7. A hand-held bending tool according to claim 2, which includes abutment means to limit a rotational path of said bending matrix.

8. A hand-held bending tool according to claim 7, which includes a housing; and in which said abutment means includes a stop means on said driven member, and at least one counter-abutment that is secured to said housing and cooperates with said stop means.

9. A hand-held bending tool according to claim 8, in which said stop means and said counter-abutments are disposed within said housing.

10. A hand-held bending tool according to claim 7, in which said abutment means includes at least one abutment on said bending matrix for defining at least a starting position for said bending matrix.

11. A hand-held bending tool according to claim 10, in which said bending matrix is provided with a recess having the shape of part of a circle with two ends, each of which defines one of said abutments.

12. A hand-held bending tool according to claim 10, which includes at least one fixed stop means that cooperates with said abutments.

13. A hand-held bending tool according to claim 1, in which said motor has at least one slip clutch that becomes operative when one end position of said bending matrix is reached.

14. A hand-held bending tool according to claim 1, which includes means for reversing a direction of rotation of said motor.

15. A hand-held bending tool according to claim 1, in which said bending matrix has at least two bending segments, each of which has a different bending radius.

16. A hand-held bending tool according to claim 15, in which said recess means of said bending matrix comprises a respective recess for each of said bending segments, with each of said recesses having a different cross-sectional width.

17. A hand-held bending tool according to claim 16, in which said recess means of said sliding shoe comprises at least two recesses, which preferably have different cross-sectional widths.

18. A hand-held bending tool according to claim 17, in which each of said bending segments is provided with a support.

19. A hand-held bending tool according to claim 18, in which each of said supports has a hook-shaped portion to form a hook opening, with said tube that is to be bent being disposed in said hook opening.

20. A hand-held bending tool according to claim 17, in which said recesses of at least one of said bending matrix and said sliding shoe are disposed at different levels.

21. A hand-held bending tool according to claim 1, which includes a housing, with said sliding shoe being mounted on said housing in such a way as to be removable or pivotable from an operative position.

22. A hand-held bending tool according to claim 21, which includes an insertion spindle for removable securing said sliding shoe to said housing, with said insertion spindle extending parallel to an axis of rotation of said bending matrix.

23. A hand-held bending tool according to claim 8, in which two said counter-abutments are provided.

24. A hand-held bending tool according to claim 10, in which two said abutments are provided on said bending matrix.

25. A hand-held bending tool according to claim 1, in which said motor has at least one slip clutch that becomes operative when both end positions of said bending matrix are reached.

26. A hand-held bending tool for conduits, tubes, and rods, including a bending matrix and a sliding shoe that during a bending process are movable relative to one another and each have a groove-like recess means in which said tube to be bent is disposed, with said recess means of said bending matrix extending in a curved manner in conformity with the tube bending radius that is to be produced, and including at least one support for said tube, the improvement wherein:

said bending tool is embodied as an electrical tool having a motor that rotatably drives said bending matrix via a reduction gear arrangement, with the flux of force during a bending process being self-contained;

said motor is an electric motor having a drive shaft that is operatively connected to a driven member of said reduction gear arrangement via an at least two-stage reduction mechanism thereof;

an abutment means is provided to limit a rotational path of said bending matrix, with said abutment means including at least one abutment on said bending matrix for defining at least a starting position for said bending matrix; and said bending matrix is provided with a recess having the shape of a circle with two ends, each of which defines one of said abutments.

* * * * *

UNITED STATES PATENT AND TRADEMARK OFFICE

CERTIFICATE OF CORRECTION

PATENT NO. : 5,056,347

DATED : October 15, 1991

INVENTOR(S) : RUDOLF WAGNER

It is certified that error appears in the above-identified patent and that said Letters Patent is hereby corrected as shown below:

On the title page, item [73], the assignment data should correctly read:

[73] Assignee: REMS-Werk Christian Fülll und Söhne GmbH & Co., Waiblingen, Fed. Rep. of Germany

Signed and Sealed this

Sixth Day of April, 1993

*Attest:*

STEPHEN G. KUNIN

*Attesting Officer*

*Acting Commissioner of Patents and Trademarks*